United States Patent [19]

Rappolt et al.

[11] 4,189,088

[45] Feb. 19, 1980

[54] CONTAINER WITH INTERLOCKING CORNERS

[75] Inventors: James F. Rappolt, Overland Park; Edward L. Osborne, Kansas City, both of Kans.

[73] Assignee: Westvaco Corporation, New York, N.Y.

[21] Appl. No.: 948,809

[22] Filed: Oct. 5, 1978

[51] Int. Cl.[2] ..... B65D 5/30

[52] U.S. Cl. ..... 229/31 R; 229/35

[58] Field of Search ..... 229/30, 31, 34, 35

[56] References Cited

U.S. PATENT DOCUMENTS

| | | | |
|---|---|---|---|
| 2,846,132 | 8/1958 | Carpenter | 229/31 R |
| 3,008,626 | 11/1961 | Lawrence | 229/35 X |
| 3,246,829 | 4/1966 | Sexton | 229/31 R |
| 3,335,935 | 8/1967 | McCallum | 229/31 R |
| 3,616,989 | 11/1971 | Martinek | 229/32 |
| 3,655,112 | 4/1972 | Jeffers | 229/DIG. 1 |
| 3,682,369 | 8/1972 | Isakson | 229/35 |

*Primary Examiner*—Davis T. Moorhead

[57] ABSTRACT

A panel locking means is provided for securing together two or more corrugated paperboard panels in face-to-face contact. For this purpose, the panels to be secured together are provided with notches which have a narrow entry portion along the edge of a panel and taper outwardly to a wider base portion interiorly of the panel, and locking tabs which have a relatively narrow hinge portion interiorly of a panel and taper outwardly to a wider end portion along the edge of the panel.

6 Claims, 4 Drawing Figures

CONTAINER WITH INTERLOCKING CORNERS

BACKGROUND OF INVENTION

The present invention relates to an improved means for retaining the side walls of a knocked down container in an upright position when the container is erected for use. In particular, the invention relates to an improved panel locking means applied to the corners of a knocked down container that is prepared from corrugated paperboard.

Folding cartons and trays having locking devices such as tabs and notches for securing the corners in the erected condition are known to those skilled in the art. Moreover, panel locking means comprising tabs and notches for corrugated paperboard are also known in the art. However, the known locking means for corrugated products have heretofore been limited to situations where only two panels are locked together, primarily because such locks have been found to be unsatisfactory for holding multiple thicknesses of heavy weight material.

Corrugated paperboard offers advantages over other packaging materials because of its great strength and durability. In particular, the vertical compression strength of corrugated paperboard is vastly superior to that of conventional paperboard packaging material. In addition, for those products which require a leak proof or moisture resistant container, corrugated paperboard can be treated with water impervious materials to satisfy such needs. Moreover, a web corner construction is particularly desireable for such products since web-type corners aid in making packages leak proof.

The known tab and notch locking schemes for corrugated materials have proven unsatisfactory for the following reasons. First, the existing tab designs tend to be weakened when folded into their mating notches particularly where the tab is creased to create a hinge connection. Secondly, the known notch configurations which have entry points that are equal to or larger than their base portions preclude the possibility of achieving a positive friction lock between the elements that can withstand the normal handling operations encountered by the container to which they are applied. Thus, the known panel locking schemes for corrugated materials are subject to premature failure, they generally do not provide sufficient holding power to maintain product integrity during normal handling, and are generally unsatisfactory for locking together multiple thicknesses of heavy weight corrugated material necessary to provide adequate strength.

SUMMARY OF INVENTION

The panel interlocking means of the present invention is particularly useful for containers that are cut and scored from corrugated paperboard in a typical die cutting operation. The panels are locked together with a simple motion wherein a locking tab element is folded over and forced into a mating locking notch to achieve an effective friction lock with a positive bottleneck resistance to inadvertant release. For this purpose, one or more edges of the container are provided with tapered locking notches, which have a narrow entry throat, and a locking tab element is formed in another wall of the container with a taper that is opposite to that of the locking notches. When the two or more panels are folded into face-to-face contact, the locking tab is folded into and locked in the notched areas to retain the panels together.

A particularly desireable feature of the present invention is the simplicity of operation that insures speed and reliability in setting up the container to which the panel locks are applied. The locking tabs may be folded either inwardly or outwardly of the container side walls. When the locking tabs are formed in the corner connecting panels of the container, the tabs are folded outwardly to project beyond an adjacent side wall. When the tabs are formed in the container side wall, they are folded inwardly to project inside of an adjacent side wall. Since the locking tabs disclosed herein are substantially distorted when locked in position, they do not function effectively in repeated use operations.

To achieve the desireable and significant features noted above, the panel locks of the present invention are disclosed herein as being applied to a tray type container formed from a blank which includes a substantially centrally located bottom panel with side walls foldably attached to the free edges thereof, and a plurality of corner connecting panels between the side walls, the intersecting edges of which are foldably attached respectively to the adjacent free edges of said walls. The corner connecting panels are each further scored with a typical diagonal score line that extends from the intersection of the foldable attachment between the side walls to a free corner edge thereof to produce two substantially identical triangular sections which provide web corners for the tray. Meanwhile, the triangular sections of each corner connecting panel and an adjacent side wall are applied with appropriate cuts to provide the improved tab and notch locking means of the present invention. For this purpose, tapered notches are applied along the free edges of two opposed side walls at points that are slightly spaced from the score lines that separate the side walls from the adjacent triangular sections of each corner panel. The notches are formed with two opposed parallel sides and two opposed tapered sides, and are arranged with narrow entry or throat portions along the free edges of the side walls and from that point taper outwardly to provide a wider base portion interiorly of, or remote from, the outer edges of the side walls. The placement of the notches in the side walls is determined by the width of the panels which form the tray side walls and ultimately by the height of the tray. Meanwhile, substantially identical and mating notches are applied to the triangular sections of each corner connecting panel that is adjacent to the notched side walls. The notches are similarly located along the free edges of the triangular sections and are spaced from the score lines between the respective side walls and corner connecting panels a distance equal to the distance established by the notches in the side walls. Finally, tapered locking tab elements are formed in the free edges of the remaining unnotched triangular sections of each corner connecting panel to mate with the previously described notches. in this regard, the tabs are arranged in the outer free edges of the remaining triangular sections at the corners of the bottom panel at points which enable the tab elements to mate with and become locked into the matching notches of each adjacent triangular section and side wall. The tab elements are formed with two opposed parallel sides and two opposed tapered sides, and are arranged with their widest portion along the free outer edges of the triangular sections and from the outer edge, tape inwardly to provide a narrower hinge portion interiorly of, or remote from, the outer edges of the triangular sections. In addition, each tab element further may include a pair of slits located opposite one another along the tapered sides of the tab which serve to provide a secondary holding effort when the tab is inserted in its mating notches. After the blank is cut and scored as described above, adhesive is applied to the notched triangular sections of each corner connecting panel, and the notched triangular sections are adhered to the side walls containing the matched notches. In this condition, the blank is partially glued and knocked down for ready erection at the point of use. The tray is subsequently squared and the panels locked together when the triangular sections containing the locking tab elements are folded into face-to-face contact with the adhered side wall and notched triangular sections and the tab element is forced past the narrow entry point of the notches to effectively secure the tab within the confines of the tapered notch walls. Such action creates a good frictional lock with an attendant bottleneck effect to prevent premature release of the tab element, and, where the tab element is provided with opposed slits, a more secure lock is achieved.

DETAILED DESCRIPTION

Figure 1:
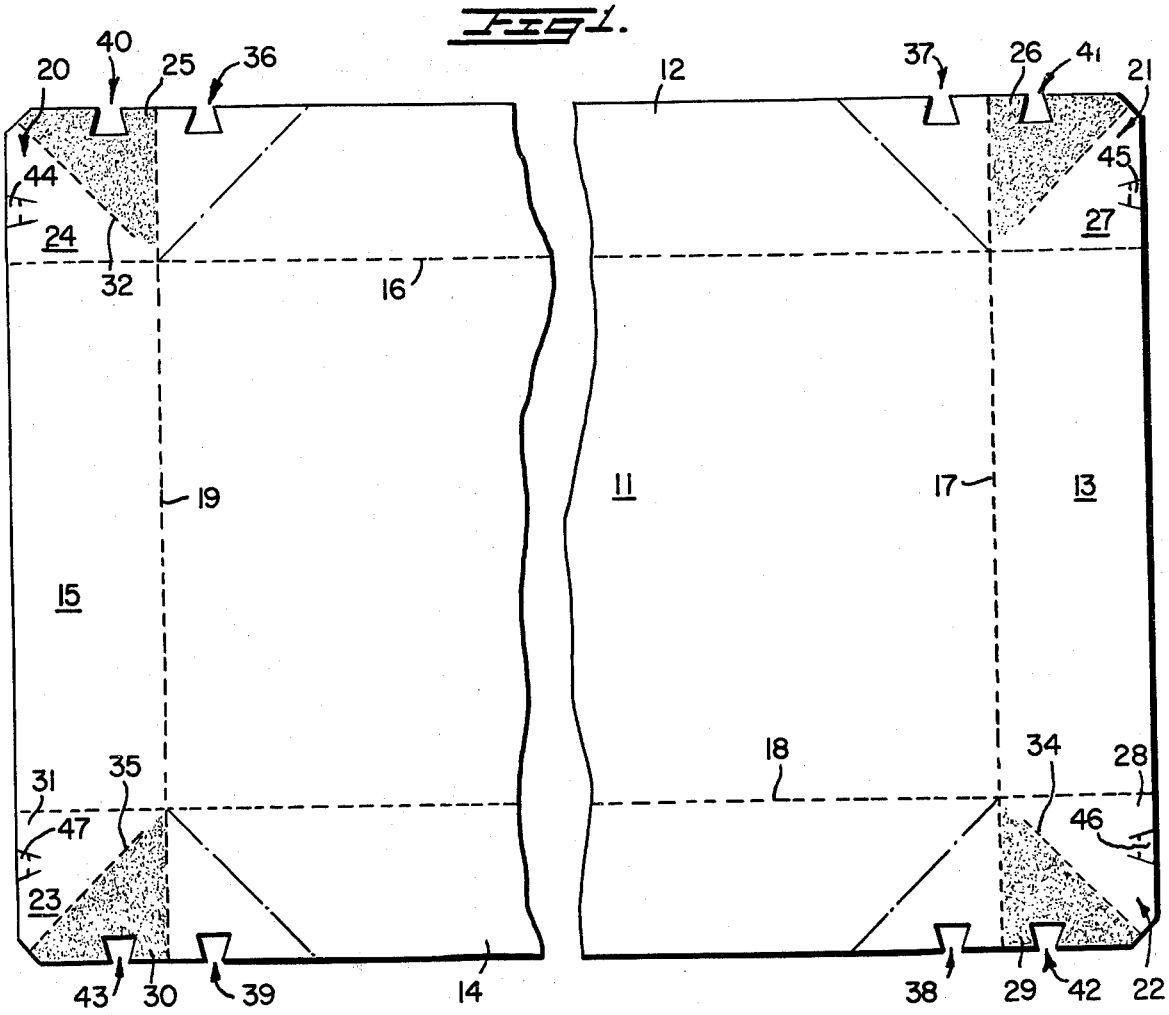
FIG. 1 is a plan view of the preferred blank construction of the present invention.

FIG. 1 illustrates the present invention as applied to a blank for constructing a web corner rectangular tray. In this regard, the tray may be used alone or it may form one or both parts of a telescoping container as desired. Thus, the blank of FIG. 1 includes a substantially centrally located rectangular bottom panel 11 having a plurality of side walls 12,13,14 and 15 connected to the free edges thereof along fold lines 16,17,18 and 19 respectively. The side walls are also foldably attached to four corner connecting panels 20,21,22 and 23 along the fold lines 16,17,18 and 19 are intersecting edges as shown. Meanwhile, the corner connecting panels are each divided into two triangular sections by the diagonal score lines 32,33,34 and 35. The diagonal scores each emanate from the intersection of the score lines joining the corner connecting panels to the side walls and continue to a free edge of the corner connecting panels. As thus described, the blank constitutes a typical construction for making a web corner tray which produces a substantially leak proof final product. To the above described construction, the improved panel interlocking feature of the present invention is applied.

Figure 4:
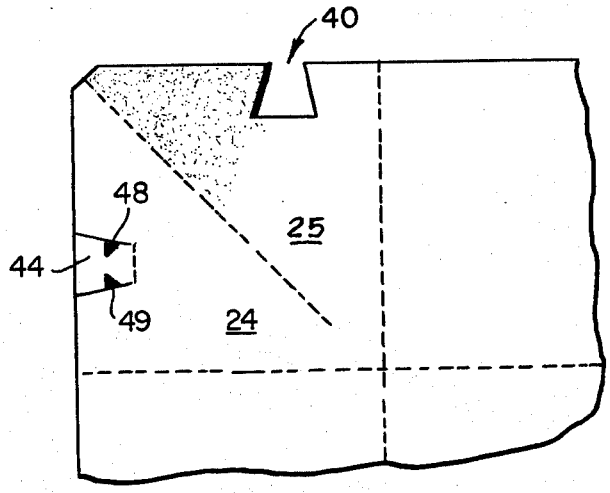

For this purpose, tapered notches 36,37 and 38,39 are applied to two opposed side walls 12 and 14 of the blank. The tapered notches are formed with two opposed parallel sides and two opposed tapered sides and are arranged to have a narrow entry portion along the edge of the side wall which expands to a wider portion interiorly of the side walls. The notches 36,38 and 37,39 are spaced from the score lines 19 and 17 respectively by a distance that is selected depending upon the desired height of the tray as determined by the width of the side walls 15 and 13. In addition, a second set of matching locking notches 40,41, 42 and 43 are formed in the adjacent triangular sections 25, 26,29 and 30 of the corner connecting panels 20,21,22 and 23. These latter notches are of the same size and shape as the notches applied to the opposed side walls 12 and 14 and they are spaced from the score lines 19 and 17 a distance equal to that of the notches 36,37,38,39. In a typical construction fro a tray measuring approximately 18×18 inches, with a side wall height of about 6 inches, the notches are located about $1\frac{1}{2}$ inches from their adjacent fold lines. Meanwhile, the notches are formed with a narrow entry portion of about $\frac{3}{4}$ inch, a depth of about 1 inch and a base portion of about 1 inch. In this manner, the locking notches 36,37,38 and 39 are arranged to be mated with the notches 40,41,42 and 43 when the side walls 15 and 13 are folded over about the score lines 19 and 17. For this purpose, adhesive is applied as shown to the triangular sections 25,26,29,30 which are in turn bonded to the side walls 12 and 14 in the areas defined by the phantom lines shown in FIG. 1 to produce the knocked down, glued configuration shown in FIG. 2. Meanwhile, the blank of FIG. 1 is completed with the application of tab locking elements 44,45,46 and 47 to the remaining unnotched triangular panels 24,27,28 and 31. The tabs are also tapered and are formed with two opposed parallel sides and two opposed tapered sides, but their taper is opposite from the taper of the locking notches formed in the opposed side walls 12 and 14 and the triangular sections 25,26,29,30. For instance, the tab lock elements 44,45,46 and 47 each have their widest portion along the free edges of the triangular sections 24,27,28 and 31, and from that point taper inwardly to a narrow portion where the tabs are joined to the triangular sections. Each tab element is also provided with opposed slits 48,49 (see detail in FIG. 4) which serve to further secure the locking tab in its matching tapered locking notches. For the tray described hereinbefore, the locking tabs are formed with a depth of about $\frac{7}{8}$ inch, a wide portion along the free edge of about $1\frac{3}{4}$ inches and a narrow hinge portion of about 1 inch. Meanwhile, the slits 48,49 are located approximately mid way between hinge portion of the tab and the end thereof. A comparison of the example dimensions suggested for the tabs and notches applied to a typical tray construction above shows that for the preferred embodiment, the widest portion of the notches is equal to the narrowest or hinge portion of the mating locking tab. This relationship is responsible for achieving the positive locking action disclosed herein.

The application disclosed for the present invention is for locking two or more layers of corrugated paperboard at each corner of a web corner tray. When set up, the tray disclosed provides an effective leak proof or leak resistant container with superior vertical column strength. This permits the trays to be stacked without fear of collapse.

Figure 2:
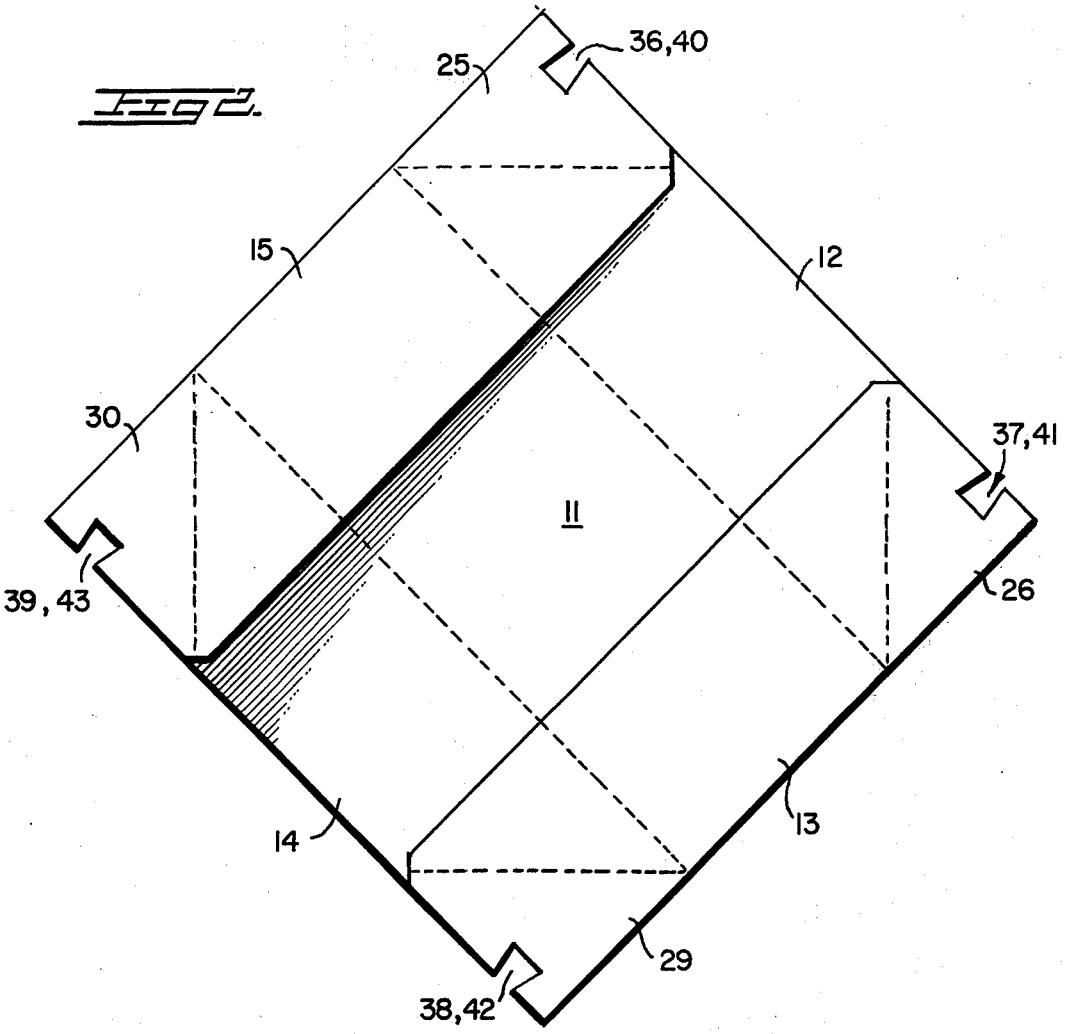
FIG. 2 is a perspective view of the blank of FIG. 1 in its pre-glued knocked down configuration.
Figure 3:
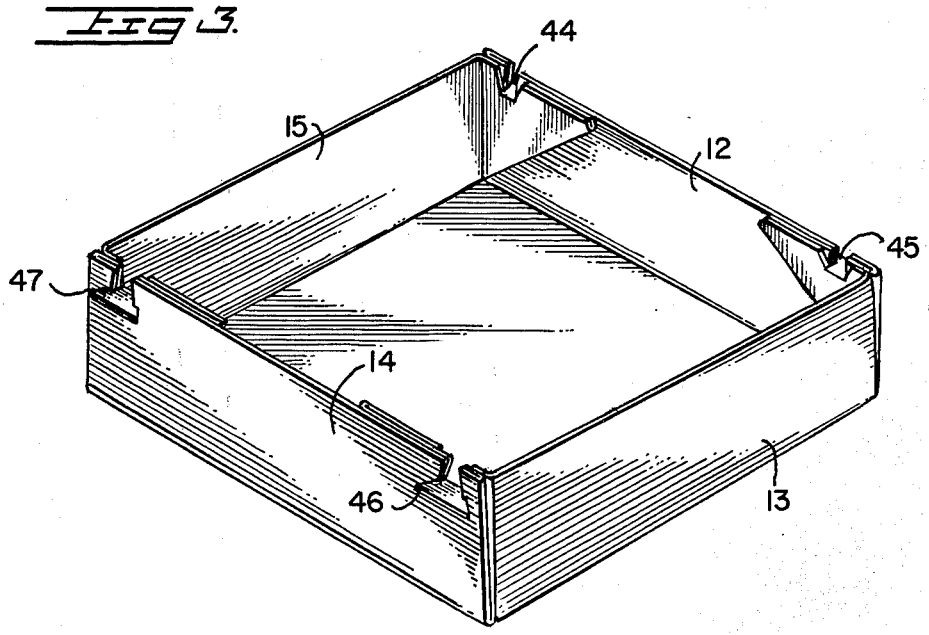
FIG. 3 is a perspective view of an erected tray prepared from the FIG. 2 configuration; and, FIG. 4 is a partial plan view showing details of the preferred construction for the tab lock element of the present invention.

The three layers of corrugated, i.e., side wall and face-to-face triangular sections of each corner panel, produce unusually great spring back pressures that require a strong and reliable lock such as disclosed herein. By reversing the taper of the locking notches and locking tabs, an improved locking action is achieved when the locking tabs are forced past the narrow entry portions of the locking notches. The improved locking action is produced as a result of the greater frictional forces generated between the tabs and notches and because the narrow entry openings of the notches produce an effective bottleneck to the inadvertent release of a tab from its matching notch. In addition, when the tabs are applied with opposed slits, the tabs tend to become crushed or distorted in the area between the slits and the hinge connection of the tabs, as the tabs grip the sides of the notches, to further improve the locking action. FIG. 2 illustrates the tray blank in its knocked down and glued condition. Meanwhile, FIG. 3 shows the tray fully erected. In FIG. 3, the locking tabs 44,45, 46 and 47 are shown as being folded into engagement with their mating locking notches to retain the corners together and maintain the side walls in an upright condition.

Thus, while the preferred embodiment herein is disclosed for interlocking three panels of corrugated paper in side-by-side relation, other applications for the present invention are readily possible. For instance, where a positive lock between only two panels is desired, the improved locking tabs and notches of the present invention could be utilized. Obviously, the angles and length of the locking tabs and notches may be varied depending on the weight of the corrugated paperboard used, the types and weight of the items to be packaged and the height of the side walls. Moreover, the tabs and notches may be arranged in different combinations on other side walls and corner connecting panels as desired within the scope of the claims appended hereto.

We claim:

1. A web corner tray capable of being erected from a knocked down condition and prepared from a single blank of corrugated paperboard comprising, a centrally located rectangular bottom panel, a plurality of side walls foldably attached to the free edges of said bottom panel, a plurality of corner connecting panels between said side walls, the intersecting edges of which are foldably attached respectively to the adjacent free edges of said side walls, and a diagonal fold line in each corner connecting panel extending from the intersection of the foldable attachment between said side walls to a free edge thereof to divide the corner connecting panels into triangular sections, the improvement comprising means for locking the triangular sections of each corner connecting panel to an adjacent side wall when the tray is erected, said locking means comprising:

(a) a plurality of first tapered notches with two opposed parallel sides and two opposed tapered sides formed in the free edges of two opposed side walls at each corner of said bottom panel;

(b) a plurality of second tapered notches with two opposed parallel sides and two opposed tapered sides formed in the free edges of the triangular sections of said corner connecting panels adjacent to said notched side walls at each corner of said bottom panel, said tapered notches having a narrow entry portion along the outer edges of said side walls and triangular sections respectively, which tapers to a wider base portion remote from said outer edges; and, (c) a plurality of tapered tabs with two opposed parallel sides and two opposed tapered sides formed in the free edges of the unnotched triangular sections at each corner of said bottom panel, said tapered tabs having a wider portion along the outer edges of said triangular sections which tapers to a smaller hinge portion remote from said outer edges and which are adapted to engage said tapered notches.

2. A locking means for securing at least two panels of corrugated paperboard in face-to-face contact comprising:

(a) a first triangular 26 panel having a notch in one edge thereof, said notch being formed with two opposed parallel sides and two opposed tapered sides to provide a narrow entry portion along the edge of said panel which tapers to a wider base portion interiorly of said panel; and, (b) a second triangular panel folded in face-to-face contact with said first 26 panel and having a locking tab in the edge thereof arranged to be engaged with the tapered notch, said locking tab element being formed with two opposed parallel sides and two opposed tapered sides and having a wide portion along the edge thereof with inwardly tapering sides to a narrow hinge portion interiorly of said second triangular panel where the tab is attached thereto.

3. The locking means of claim 2 wherein the side edges of said tapered notch and tapered locking tab are substantially straight from their narrow portions to their wider portions.

4. The locking means of claim 3 wherein the tapered locking tab contains a pair of opposed notch gripping slits along the side edges thereof located substantially midway between the narrow hinge portion and the wider outer edge portion.

5. The locking means of claim 4 wherein the base portion of said tapered notch is substantially equal in width to the narrow hinge portion of said locking tab.

6. The locking means of claim 5 wherein the width of said locking tab between the ends of said slits is substantially equal to the width of the base portion of said tapered notch.

* * * * *